US005524874A

United States Patent [19]

Tojima et al.

[11] Patent Number: 5,524,874

[45] Date of Patent: Jun. 11, 1996

[54] IMAGE FORMING APPARATUS AND SHEET FEED UNIT

[75] Inventors: Takahito Tojima, Yamato; Akira Yasuda, Kawagoe; Makoto Ishikawa, Tokyo, all of Japan

[73] Assignee: Riso Kagaku Corporation, Tokyo, Japan

[21] Appl. No.: 290,298

[22] Filed: Aug. 15, 1994

[30] Foreign Application Priority Data

Aug. 20, 1993 [JP] Japan ..... 5-206655

[51] Int. Cl.[6] ..... B65H 1/08

[52] U.S. Cl. ..... 271/126; 271/147; 271/162

[58] Field of Search ..... 271/10.01, 10.11–10.13, 271/12.6, 109, 117, 147, 155, 157, 162, 4.01

[56] References Cited

U.S. PATENT DOCUMENTS

| | | | |
|---|---|---|---|
| 3,806,112 | 4/1974 | Melby et al. | 271/10.13 |
| 4,678,180 | 7/1987 | Tamura et al. . | |
| 4,968,016 | 11/1990 | Koyama | 271/162 |
| 5,026,041 | 6/1991 | Kitazume et al. . | |
| 5,060,926 | 10/1991 | Murai et al. . | |

FOREIGN PATENT DOCUMENTS

| | | | |
|---|---|---|---|
| 0227635 | 12/1984 | Japan | 271/162 |
| 0230426 | 9/1988 | Japan | 271/162 |
| 0220647 | 9/1989 | Japan | 271/166 |
| 404125233 | 4/1992 | Japan | 271/162 |

*Primary Examiner*—H. Grant Skaggs
*Attorney, Agent, or Firm*—Kanesaka & Takeuchi

[57] ABSTRACT

An image forming apparatus includes a body equipped with an image forming device, a pick-up means provided in one part of the body for taking image forming sheets into the body, and a sheet feed unit releasably mounted on one part of the body for loading a plurality of sheets stacked and for pushing the sheets into the pick-up device.

10 Claims, 21 Drawing Sheets

IMAGE FORMING APPARATUS AND SHEET FEED UNIT

BACKGROUND OF THE INVENTION

The present invention relates to an image forming apparatus such as a printing apparatus, an electronic reproduction apparatus, etc. and, more particularly, to an image forming apparatus having a removable feed unit for feeding an image forming material, and to the feed unit.

Generally, a printing apparatus is used for processing paper of the same size in large quantities. A paper feeding apparatus for feeding paper to the printing apparatus, therefore, is designed to load large quantities of paper of specific size, to be attached to the printing apparatus, and to feed the paper.

Conventional printing apparatus and the paper feeding apparatus are connected into a one-body special machine for printing only paper of a certain specific size on the whole.

The conventional printing apparatus or paper feeding apparatus is applicable only to printing paper of a specific size, and is not widely usable for various sizes of paper.

In the conventional image forming apparatus described above, when paper of a size not usable in the paper feeding apparatus connected to the image forming apparatus is to be fed, it is necessary to replace the existing paper feeding apparatus with another paper feeding apparatus suitable for the paper size. However, the conventional paper feeding apparatus stated above, having a pick-up roller, etc. for picking up paper loaded and for feeding it into the printing apparatus, is of so complicated construction and heavy weight as to defy easy installation and removal.

In view of the above-described various disadvantages inherent in the heretofore known apparatus, it is an object of the present invention to provide an image forming apparatus in which a paper feed unit can very easily be installed and removed in accordance with the size of paper to be used, and the paper feed unit of simple construction as stated above.

SUMMARY OF THE INVENTION

The image forming apparatus defined in the first aspect of the present invention comprises a body equipped with an image forming means, a pick-up means provided in a part of the body for picking up into the body a sheet on which an image is to be formed, and a feed unit removably mounted in a part of the body, for holding a plurality of sheets stacked, and for feeding the sheet into the pick-up means.

The image forming apparatus defined in the second aspect of the present invention has a frame which is fixed to the body in a specific attitude, with the feed unit of the image forming apparatus of the first aspect releasably retained to a part of the body.

The image forming apparatus defined in the third aspect of the present invention is of such a constitution that, in the image forming apparatus of the second aspect, the frame retained to a part of the body, except for the retained portion, is designed to be held suspended from the body without interference with the body.

The image forming apparatus defined in the fourth aspect of the present invention is of such a constitution that, in the image forming apparatus of the first aspect, the feed unit has a sheet loading table for loading the sheets, a driving means for moving the sheet loading table up and down, and a connecting section on the driving means side for connection to the connecting section on the body side when the driving means is fixed to the body.

The image forming apparatus defined in the fifth aspect of the present invention is so constituted that, in the image forming apparatus of the fourth aspect, the feed unit will be secured in a specific attitude to the body, removably retained to a part of the body to allow rocking on the center of one shaft.

The image forming apparatus defined in the sixth aspect of the present invention is of such a constitution that, in the image forming apparatus of the fifth aspect, when the feed unit retained to a part of the body is swung for fixing in a specific attitude to the body, the connecting section on the driving means side and/or the connecting section on the body side which are to be connected to each other can rotate.

The image forming apparatus defined in the seventh aspect of the present invention is provided, in the image forming apparatus of the first aspect, with a housing space for housing a part of the feed unit mounted on the body and with a base in a specific position of the body for bearing the load of both the feed unit and the body.

The sheet feed unit defined in the eighth aspect of the present invention is a sheet feed unit which is applied to the image forming apparatus having a body provided with an image forming means and a pick-up means mounted in a part of the body for taking, into the body, the sheet for image formation; it stores a plurality of sheets stacked, is removably mounted to a part of the body, and serves to feed the sheet to the pick-up means.

The sheet feed unit defined in the ninth aspect of the present invention has a frame to be fixed to the body in a specific attitude and releasably retained to a part of the body in the sheet feed unit of the eighth aspect.

The sheet feed unit defined in the tenth aspect of the present invention has, in the sheet feed unit of the eighth aspect, a sheet feed table on which the sheets are loaded, a driving means for moving the sheet feed table up and down, and a connecting section on the driving means side which is connected to the connecting section on the body side when the sheet feed unit is secured to the body.

The frame of the feed unit, retained to one part of the body, is suspended from the body. This frame is shaken to guide a part of the feed unit into the housing space of the base connected to the body, and thereafter, the feed unit is fixed to the body in the specific attitude. When the feed unit is fixed to the body in the specific attitude, the connecting section of the feed unit driving unit is connected to the connecting section on the body side. The feed unit driving part drives the sheet feed table to feed the sheets to the pick-up means of the body. The pick-up means picks up the sheet and feeds it to the image forming means of the body.

DETAILED DESCRIPTION OF THE PREFERRED EMBODIMENT

Figure 1:
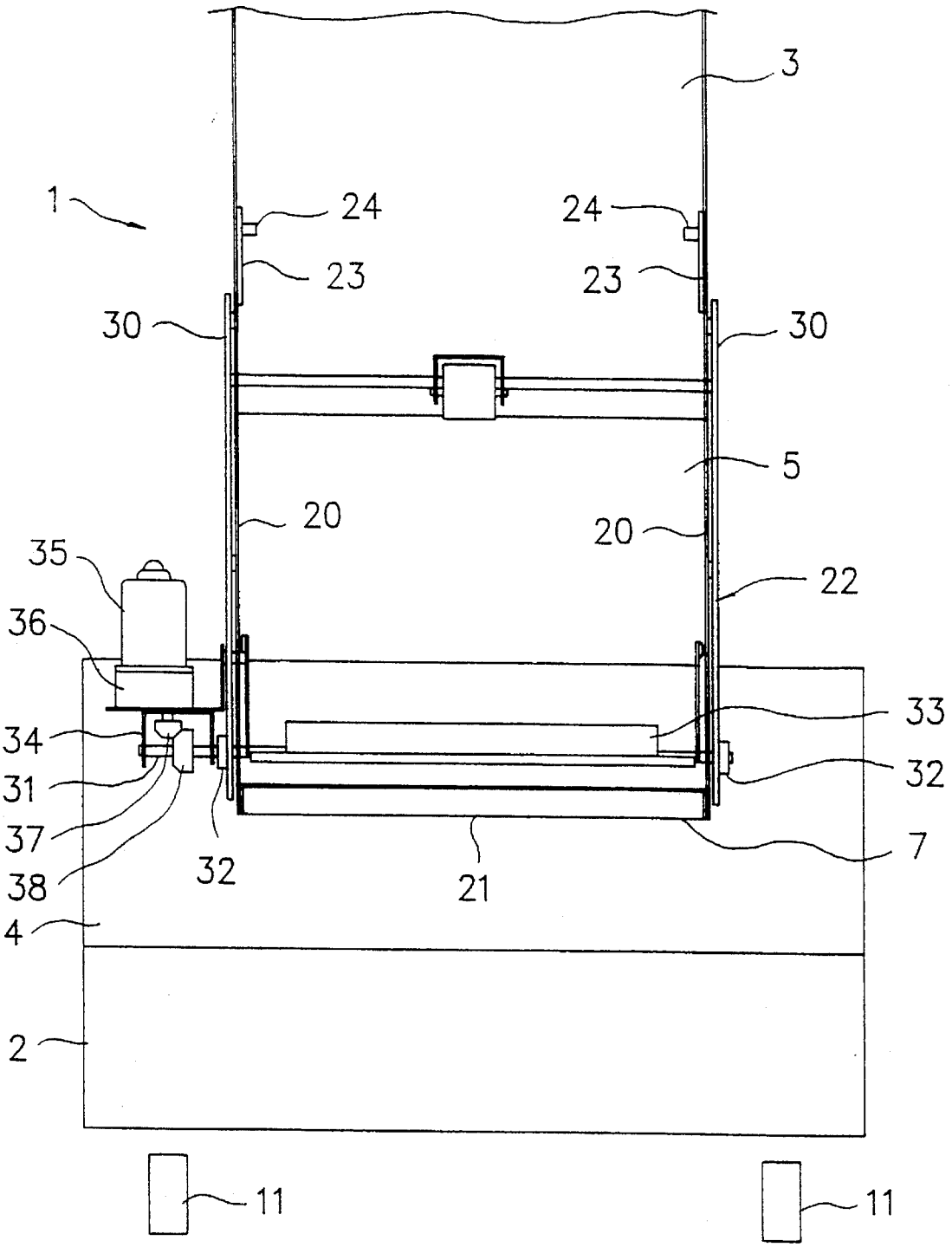
FIG. 1 is a side view of one embodiment of the present invention.

One exemplary embodiment of an image forming apparatus and a sheet feed unit will be explained with reference to FIGS. 1 to 25.

The present invention pertains to a printing apparatus which is one embodiment of the image forming apparatus. The printing apparatus 1 has a body 3 mounted on a base 2 as shown in FIG. 5(*a*), and, as shown in FIGS. 5(*b*), 5(*c*) and 5(*d*), sheet feed units 7, 8 and 9 for feeding a sheet-like printing paper 6 are removably mounted. There are prepared a plurality of types of feed units 7, 8 and 9 in accordance with the size and number of printing paper 6 to be fed, which can be selected as desired and can also be removably installed on the body 3 side.

The printing apparatus 1 equipped with the feed unit 7 for a multitude of sheets will be explained by referring to FIGS. 1 to 4 and FIG. 25.

The base 2 supports the weight of the whole body of the apparatus. The base 2 has wheels 11, by which the whole body of the apparatus can be moved around. The base 2 is provided with a step-like cutout in one side to form a housing space 4 for housing the feed unit 7.

On the upper surface of the base 2 is mounted the body 3 of the printing apparatus 1. Approximately the lower half of one side of the body 3 retreats to form a recess, which serves as a housing space 5 continued to the housing space 4 of the base 2, for housing the feed unit 7.

The body 3 is mounted on the base 2 through a leg section 12 provided with rubber, and is set on the base 2 by a connecting means not illustrated. The number and arrangement of the leg sections 12 are so determined as to firmly support the body 3 when the feed unit 7 is installed in the housing space 5 of the body 3.

Figure 25:
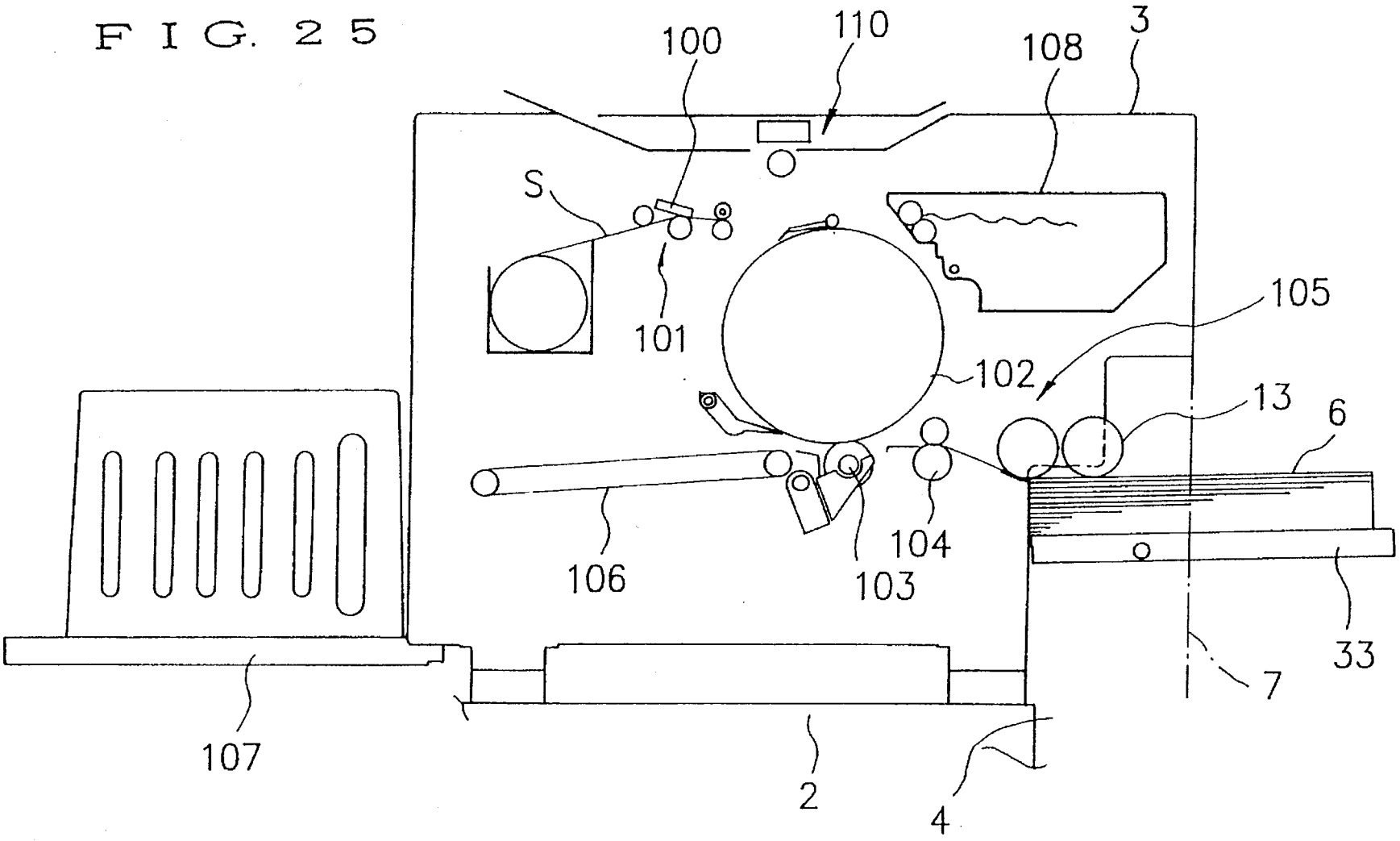
FIG. 25 is a view showing the constitution of the body of a printing apparatus in one embodiment of the present invention.

Hereinafter the body 3 will be explained with reference to FIG. 25. The body 3 of the printing apparatus 1 has an original image reading section 110 composed of an image scanner and so forth for reading the image from an original master copy to be printed, a stencil producing section 101 including a thermal head 100 for creating a dotted image by a dot-matrix process on a thermosensitive stencil original S in accordance with an original image data read by the original image reading section 110, a cylindrical, multi-porous, ink-pervious printing drum 102 around the outer peripheral surface of which the stencil S created by the printing plate producing section 101 is wrapped, a press roller 103, a paper feeding section 105 for separating, into each sheet, sheet-like materials to be printed as the printing paper 6 stacked on a paper feed table 33, by means of a pick-up roller 13, and for feeding the sheets in between the printing drum 102 and the press roller 103 by means of a timing roller 104, a paper discharge table 107 for stacking printed paper 6, and a used stencil discharge section 108 for discarding the used stencil S stripped from the printing drum. In the body 3 of such a constitution, the printing drum 102 is driven to rotate clockwise in the drawing on the central axis of itself by a driving means not illustrated, and furthermore the printing paper 6 is transferred from the right to the left in the drawing simultaneously with the rotation of the printing drum 102 while being fed in between the printing drum 102 and the press roller 103. The printing paper 6 is then pressed with a specific amount of pressure against the stencil S wrapped around the printing drum 102 by the press roller 103, thus forming a mimeographed image on the printing surface of the printing paper 6.

Figure 4:
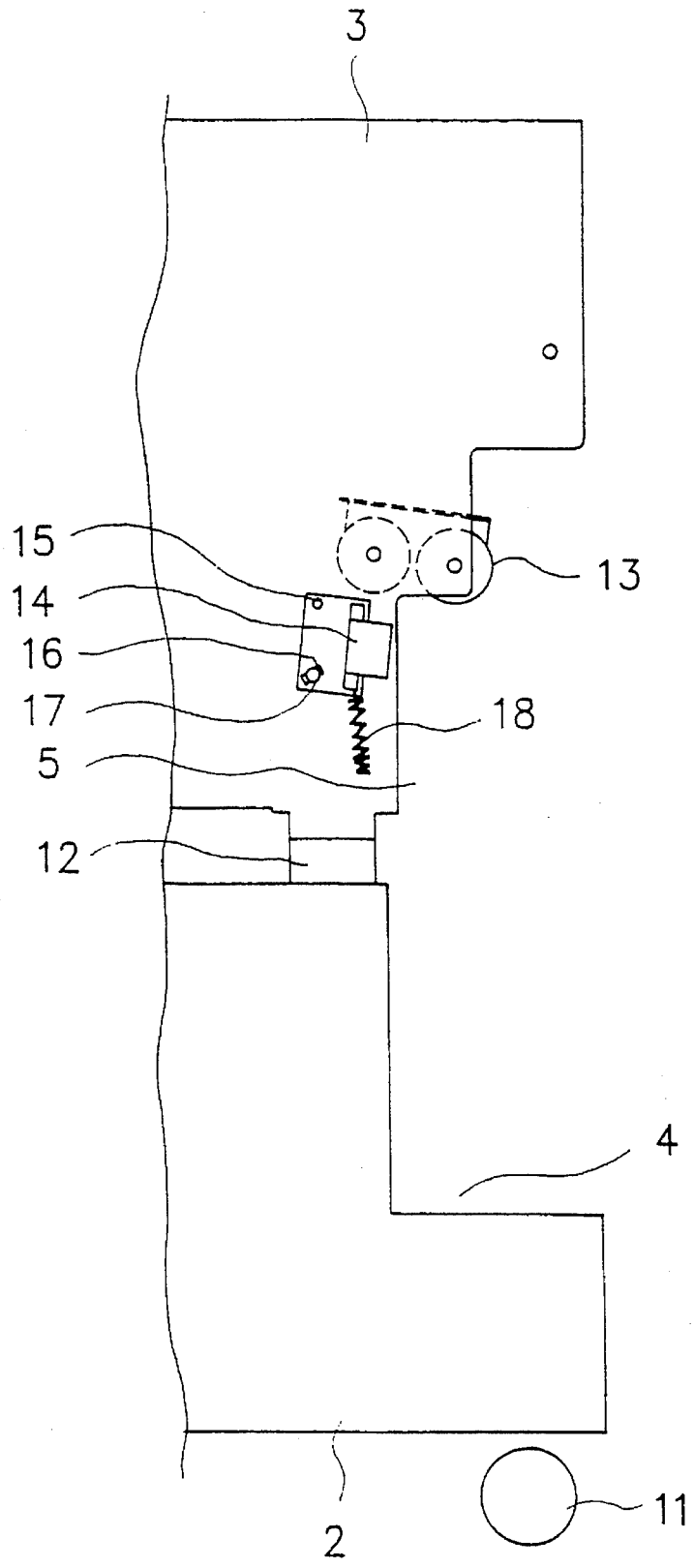
FIG. 4 is a front view of a body in one embodiment of the present invention.
Figure 5C:
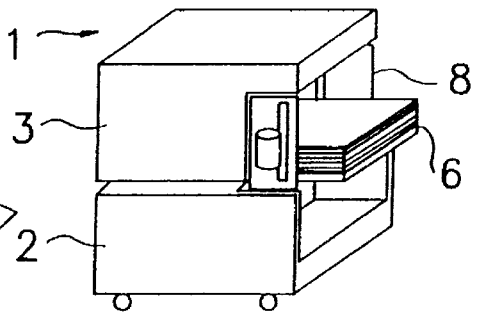
FIGS. 5(*a*) to 5(*d*) are typical perspective views showing a combination of the body and each feed unit in one embodiment of the present invention.
Figure 5D:
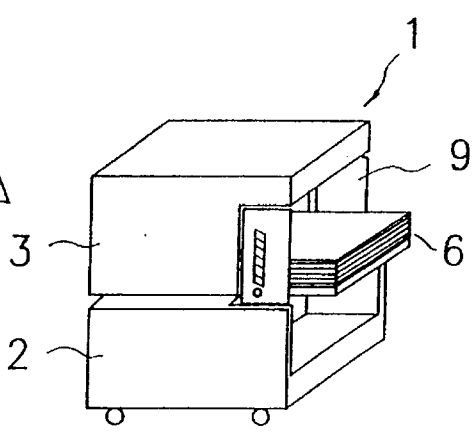
Figure 5A:
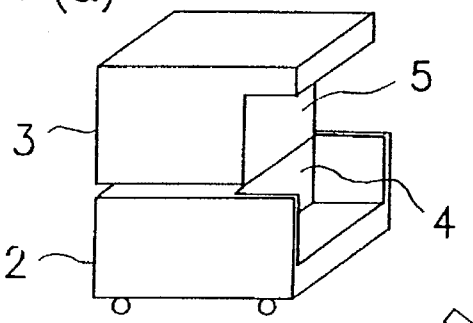
Figure 5B:
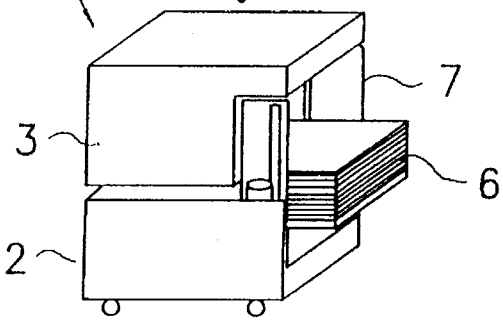
Figure 6:
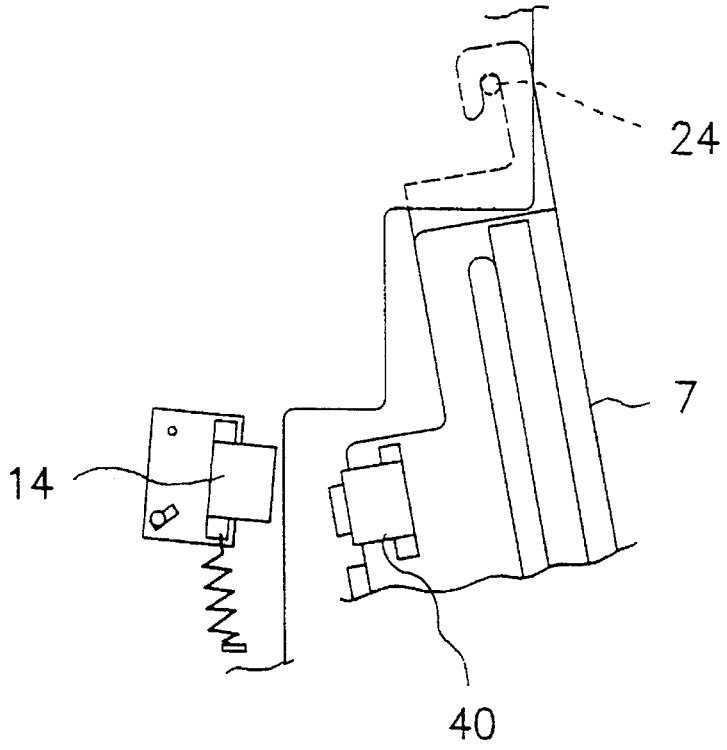
FIG. 6 is a view showing installation and removal of connectors in one embodiment of the present invention.
Figure 7:
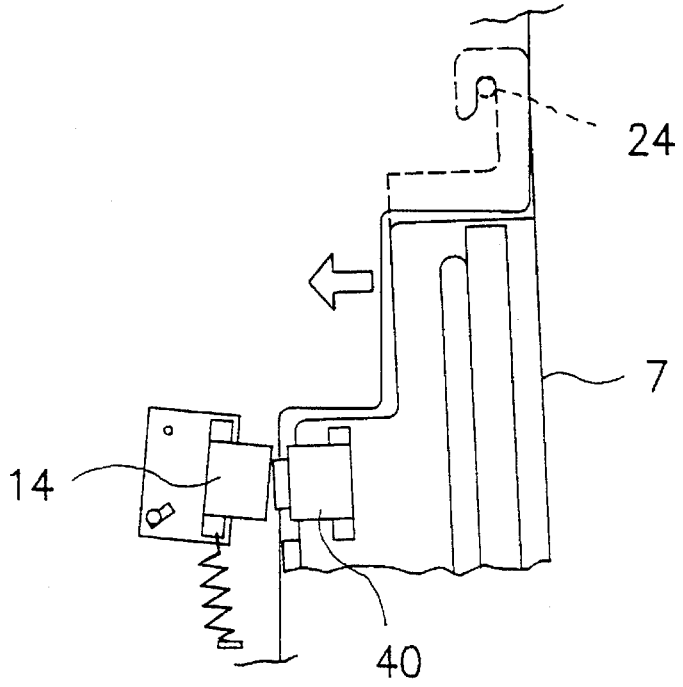
FIG. 7 is a view showing installation and removal of connectors in one embodiment of the present invention.
Figure 8:
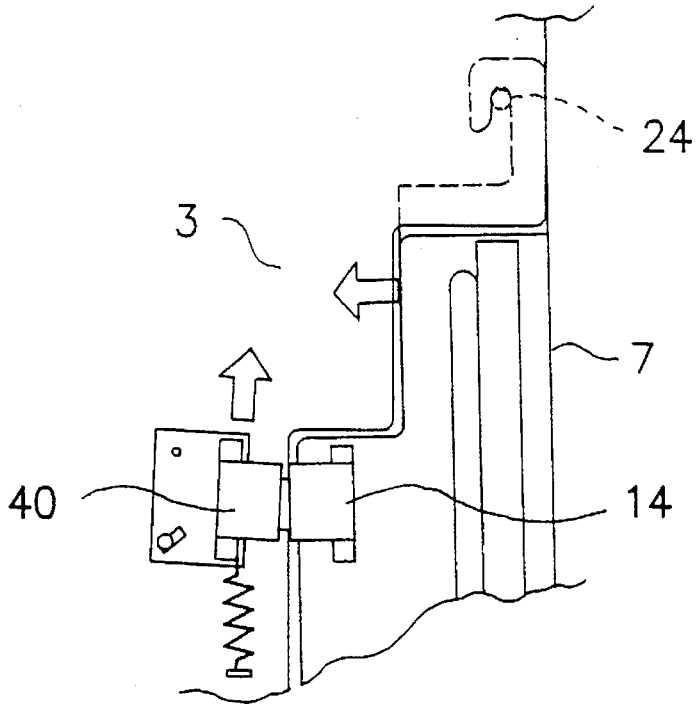
FIG. 8 is a view showing installation and removal of connectors in one embodiment of the present invention.
Figure 9:
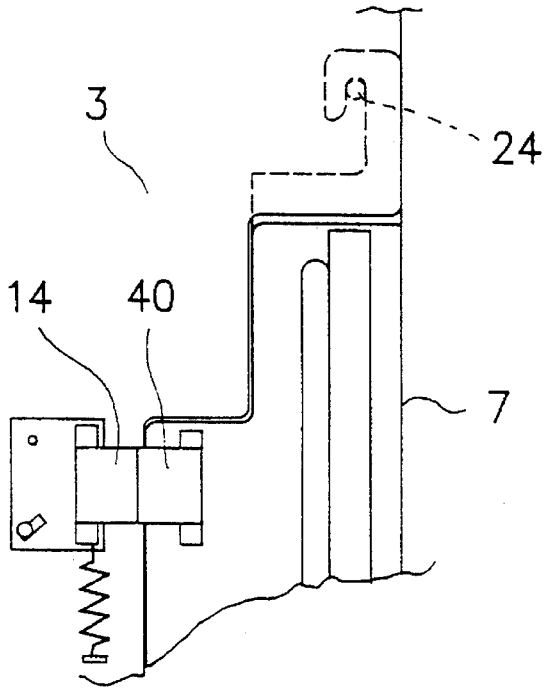
FIG. 9 is a view showing installation and removal of connectors in one embodiment of the present invention.
Figure 10:
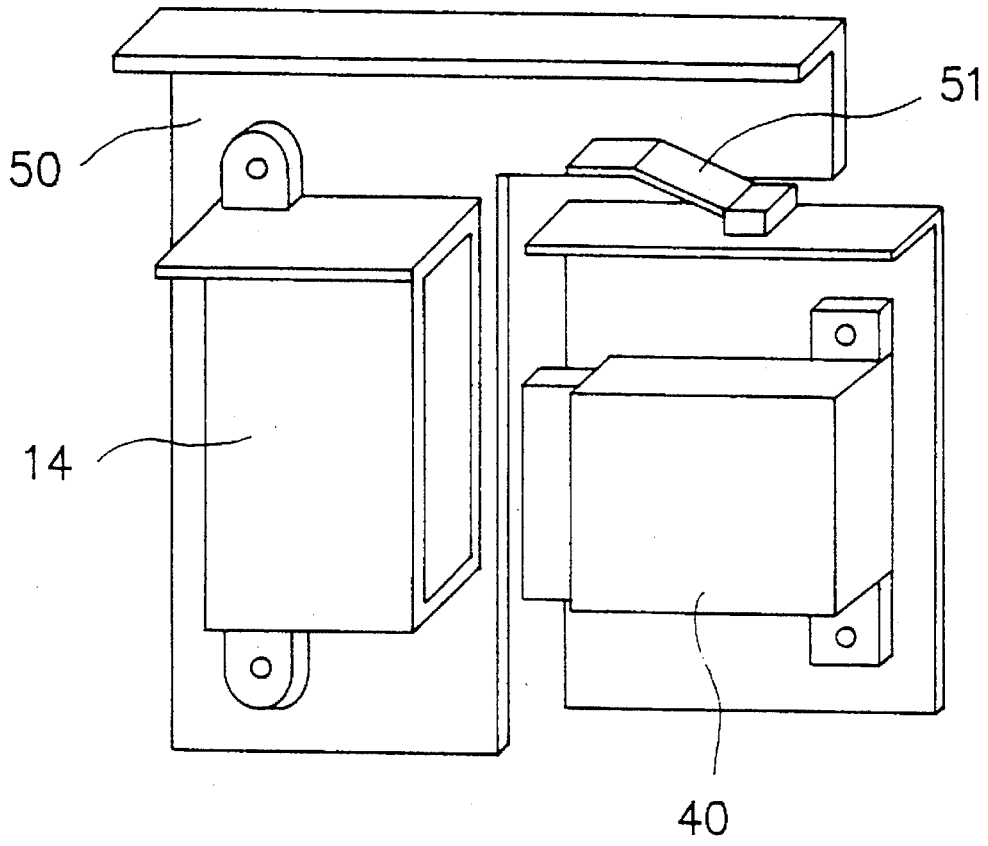
FIG. 10 is a perspective view showing another embodiment of constitution of the connectors in one embodiment of the present invention.
Figure 11:
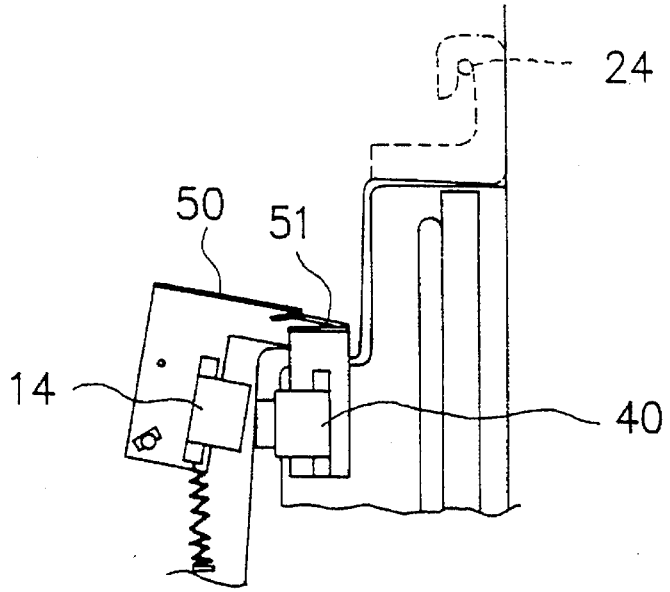
FIG. 11 is a view showing the function of the connectors in another embodiment of constitution shown in FIG. 10.
Figure 12:
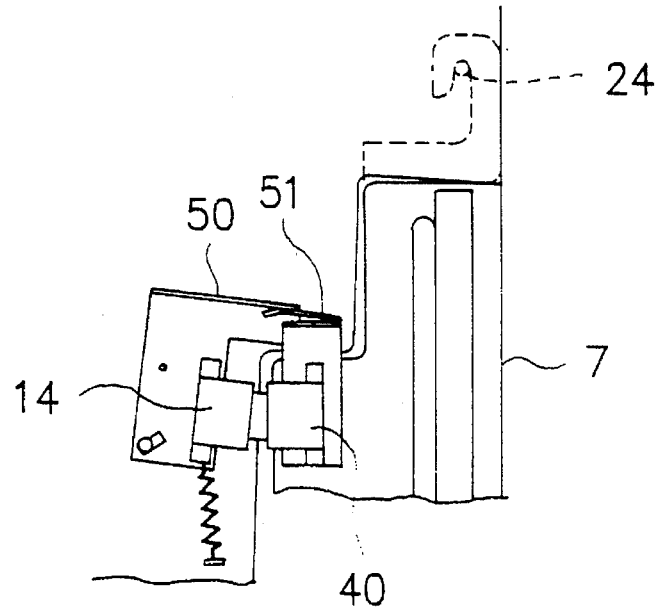
FIG. 12 is a view showing the function of the connectors in another embodiment of constitution shown in FIG. 10.
Figure 13:
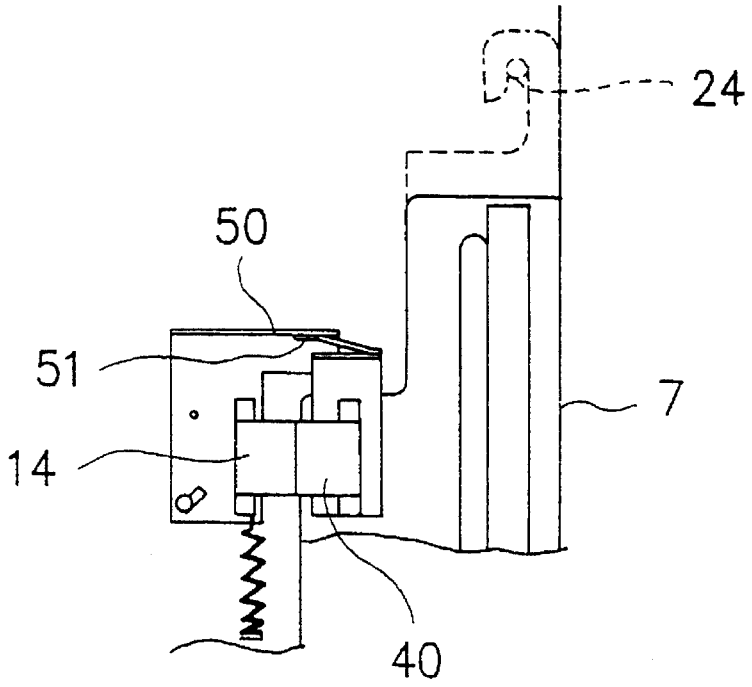
FIG. 13 is a view showing the function of the connectors in another embodiment of constitution shown in FIG. 10.

As shown in FIG. 4, the pick-up roller 13 as a means for picking up and transferring the printing paper 6 to the printing section is provided on one side of the body 3 facing the housing space 5 of the body 3.

As shown in FIG. 4, the body 3 is provided with a connector 14 for electrical connection with the feed unit 7. The connector 14 is connected with a control unit, not shown, of the body 3, and control information inputted on a control panel not shown on the body 3 side is sent to the feed unit 7 through the connector 14.

The connector 14 is rotatably mounted on the frame of the body 3 through a support shaft 15. The connector 14 has a guide slot 16, in which a guide pin 17 of the body 3 engages. Therefore, the connector 14 can swing on the center of the support shaft 15 within a specific range along the guide slot 16. The lower end of the connector 14 is connected through a spring 18 with a part of the body 3 below the connector 14. The connector 14 is set with its forward end inclined a little obliquely downwardly. The connector 14 swings upwardly when a pressure is applied, and is returned to the original position with the force of the spring 18 when the pressure is removed.

Next, the feed unit 7 will be explained with reference to FIGS. 1 to 3.

The feed unit 7 has a frame 22 including a pair of right and left side plates 20, 20 and a bottom plate 21 connected at the lower end with the side plates 20, 20. At the upper end of the side plates 20, 20 of the frame 22 are fixedly installed hooks 23, 23 as retaining means respectively. The frame of the body 3 is provided with a boss 24 as a retaining means. The feed unit 7 is hung on the body 3 as shown in FIG. 2 by attaching the hook 23 of the frame 22 to the boss 24, so that the feed unit 7 can swing on the center of the boss 24.

On the side of the body 3 of the frame 22 of the feed unit 7 is provided a stop plate 25, which comes in contact with the body 3 in a position where the feed unit 7 is fixed to the body 3. The side plate 20 of the frame 22 has a connecting flange 27 having a hole 26 formed by a second fixing means; the body 3 has a hole 28 defined by a first fixing means corresponding to the hole 26 of the connecting flange 27.

In the side plates 20, 20 of the frame 22 of the feed unit 7 are formed long guide holes 29, 29 in a vertical direction. On the outside surface of the side plates 20, 20 are fixedly installed racks 30, 30 in a vertical direction along the guide holes 29, 29. A driving shaft 31 is inserted horizontally through in the guide holes 29, 29. On both ends of the driving shaft 31 are fixedly mounted gears 32, 32, which are in mesh with the racks 30, 30 respectively.

On the driving shaft 31 between the side plates 20, 20 is mounted the paper feed table 33 which serves as the sheet loading table for the printing paper 6. One end of the driving shaft 31 is protruding out of one of the side plates 20, and a bracket 34 is attached on this one end. The bracket 34 is connected to the paper feed table 33 through the guide hole 29. On this bracket 34 a motor 35 as a driving means is mounted. The motor 35 is coupled with the driving shaft 31 through a gear box 36 and a pair of gears 37 and 38.

According to the above-described constitution, when the motor 35 is driven to rotate the driving shaft 31, the gears 32, 32 in mesh with the racks 30, 30 rotate to move the driving shaft 31 up and down along the guide hole 29 and accordingly the paper feed table 33, the motor 35 and the bracket 34 also go up and down as one body.

Figure 2:
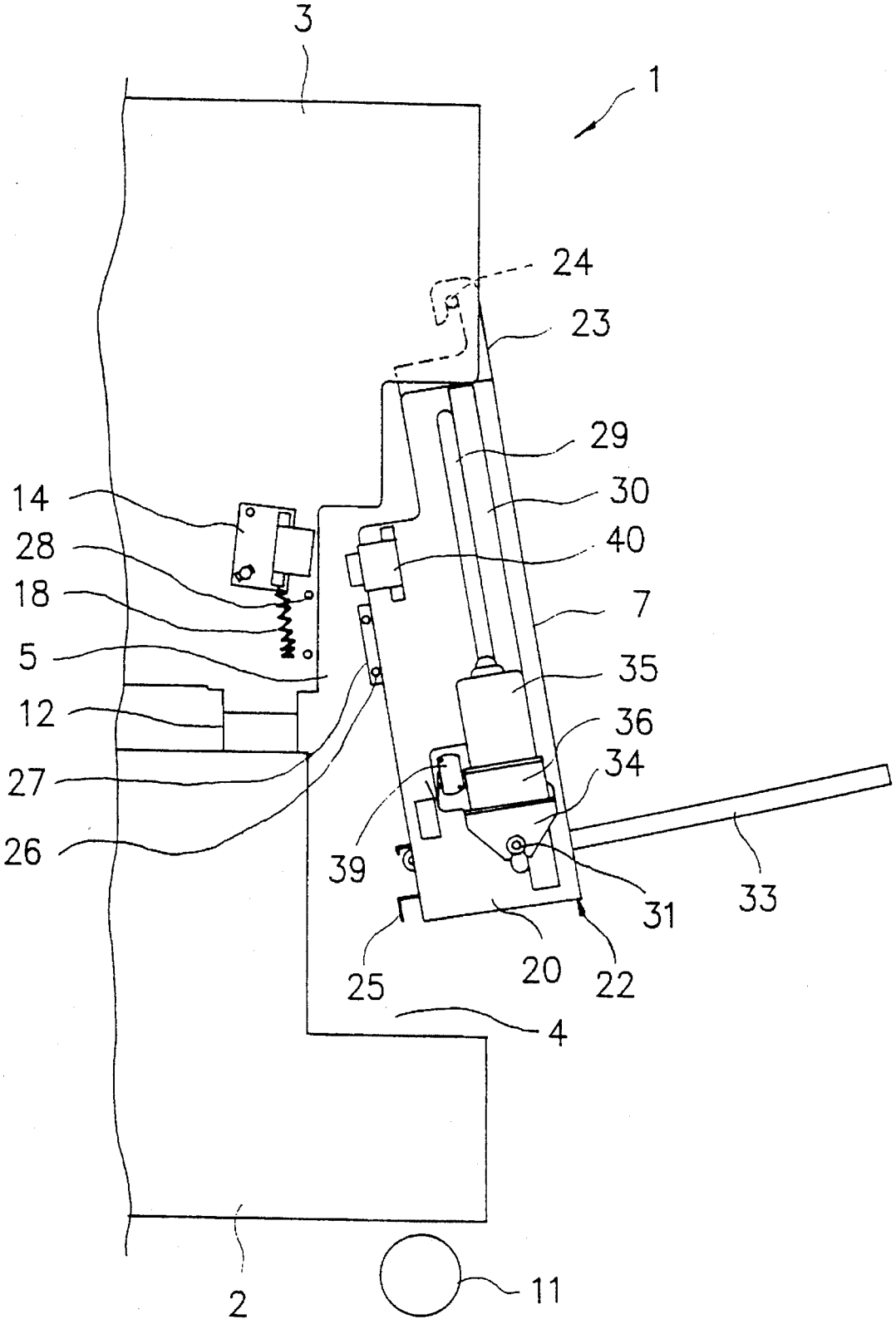
FIG. 2 is a front view of one embodiment of the present invention with a feed unit mounted.

As shown in FIG. 2, the bracket 34 of the motor 35 is provided with a lower-limit switch 39, which is set to stop the driving of the motor 35 in the lower-limit position of the paper feed table 33.

A connector 40 connected to a cable of the motor 35 is located on the body 3 side of the side plate 20 as shown in FIG. 2. When this connector 40 is connected to the connector 14, the control unit on the body 3 side is now ready to send a control signal to the motor 35.

Next, the installation of the feed unit 7 to the body 3 will be explained.

When a hand is released from the hook 23 of the feed unit 7 attached on the boss 24 of the body 3, the feed unit 7 hangs from the body 3 with the paper feed table 33 inclined from the vertical position thereof. In this state, the feed unit 7 is attached on the body 3 side only by means of the hook 23, and is off in other parts from the body 3.

Figure 3:
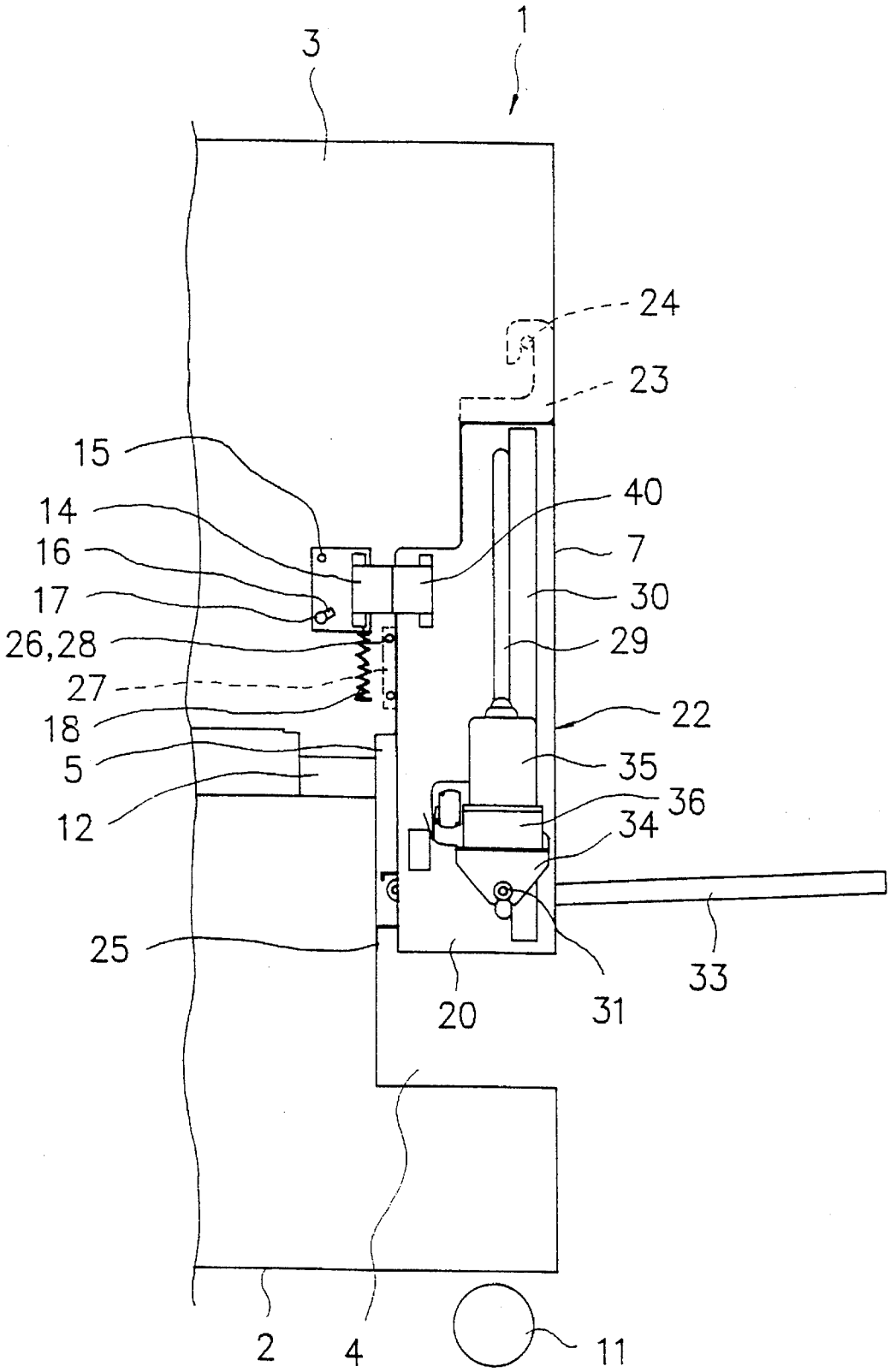
FIG. 3 is a front view of one embodiment of the present invention.

Then, the feed unit 7 is pushed by hand to swing towards the body 3 side, thus moving the stop plate 25 of the feed unit 7 into contact with the base 2 as shown in FIG. 3. In this position the feed unit 7 is secured, and housed in the housing space 4, 5 with the hole 26 of the connecting flange 27 aligned with the hole 28 of the body 3. Subsequently when a bolt as a fastening means is inserted into the holes 26 and 28 and is locked with a nut, the feed unit 7 will be securely fixed to the body 3.

It is generally hard for one person to perform the fastening work described above while supporting, in a specific position, the feed unit 7 which is considerably heavy. According to the mounting structure of the present embodiment, the feed unit 7 can be safely installed by one person.

That is, after the feed unit 7 is suspended by the hook 23 on the body 3, it will become unnecessary for the worker to support the weight of the feed unit 7. The feed unit 7 thus suspended can easily be swung on the center of the boss 24, and also can easily be guided to a specific fastening position set in one position in the direction of swinging.

With the mounting of the feed unit 7 described above, the connectors 14 and 40 are connected with each other. As shown in FIGS. 6 to 9, when pushed with the connector 40 of the feed unit 7, the connector 14 of the body 3 will be connected to the connector 40 while swinging upwardly on the center of the support shaft 15. The connector 40 of the feed unit 7 approaches with a circular motion around the center of the boss 24, but since the other connector 14 to be connected can also swing, the connectors 14 and 40 will smoothly be connected without mechanical difficulty. The connectors 14 and 40, therefore, can smoothly and reliably be connected and disconnected with the installation and removal of the feed unit 7.

After the feed unit 7 is mounted to the body 3 as described above, the printing paper 6 of a specific size will be loaded on the paper feed table 33. The feed unit 7 is a large-capacity unit capable of holding a multitude of sheets; for example about 2000 sheets of printing paper 6 can be loaded at one time.

During printing, the motor 35 is driven according to a control signal from the body 3, gradually moving the paper feed table 33 upwardly until the pick-up roller 13 comes into constant proper contact with the upper surface of the printing paper 6. The pick-up roller 13 carries the printing paper 6 towards the printing section of the body 3.

Next, another embodiment of connector construction will be explained with reference to FIGS. 10 to 13. In the above-described embodiment the connector 14 of the body 3 is directly pushed to swing by the connector 40 of the unit. It, however, should be noted that the connector 14 on the body 3 side may be swung through an intermediate member.

That is, the connector 14 is fixedly mounted on the operation panel 50 in such a manner that the operation panel 50 is swingable within a specific range in relation to the frame of the body 3. The other connector 40 on the unit side has a plate spring-like operating piece 51. At the time of installation of the feed unit 7, the operating piece 51 pushes the upper part of the operation panel 50 before contacting both of the connectors 14, 40, thereby turning the connector 14.

In the aforesaid embodiment the hook 23 of the feed unit 7 is attached on the boss 24 of the body 3. It is to be noted, however, that as shown in FIG. 14 a pin 55 as a retaining means provided on the feed unit 7*a* side may be inserted and retained in the slot 56 as a retaining means provided in the body 3 for the purpose of obtaining the same effect as one embodiment described above.

Figure 14:
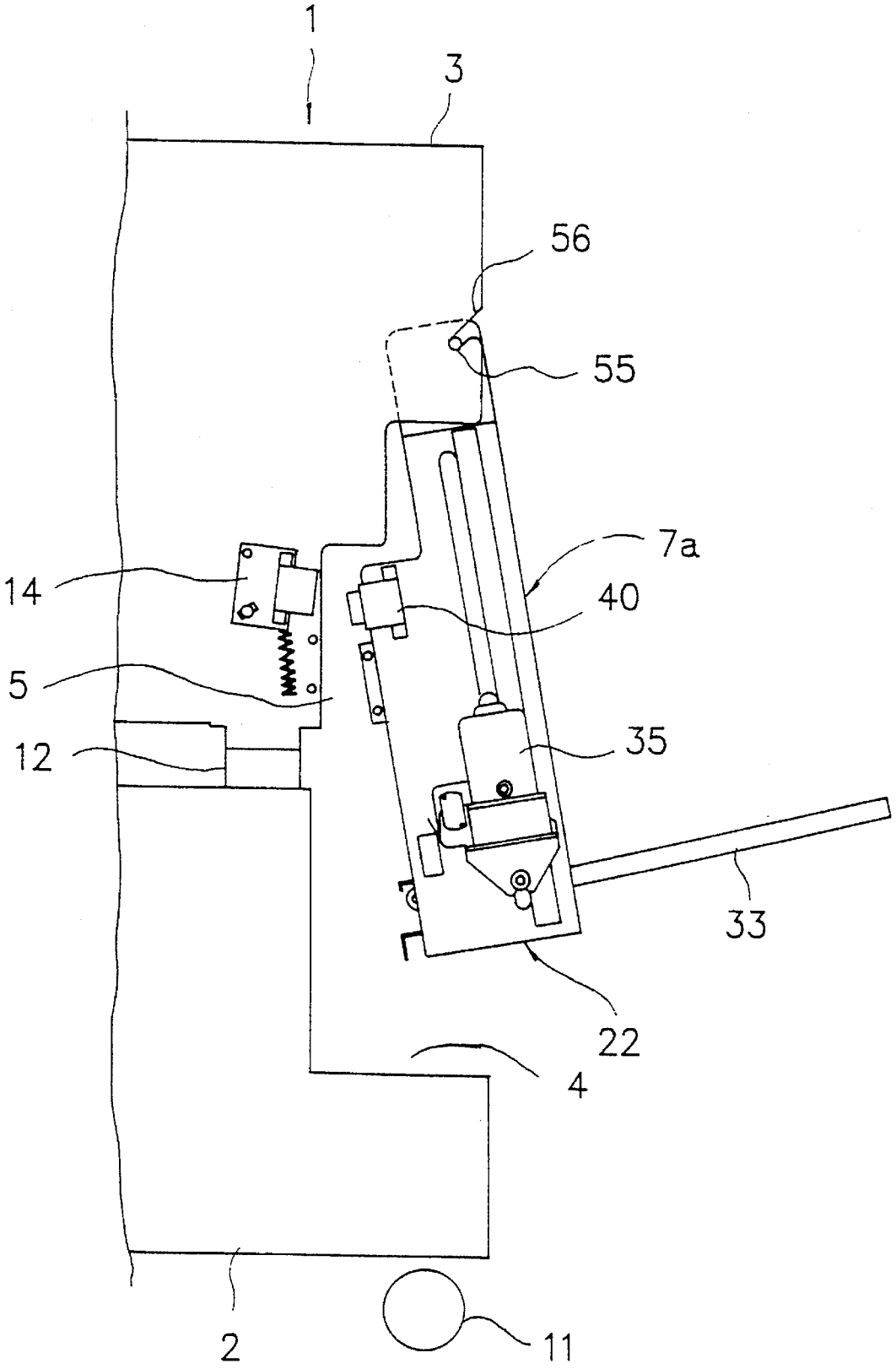
FIG. 14 is a front view showing another example of constitution of the feed unit in one embodiment of the present invention.
Figure 15:
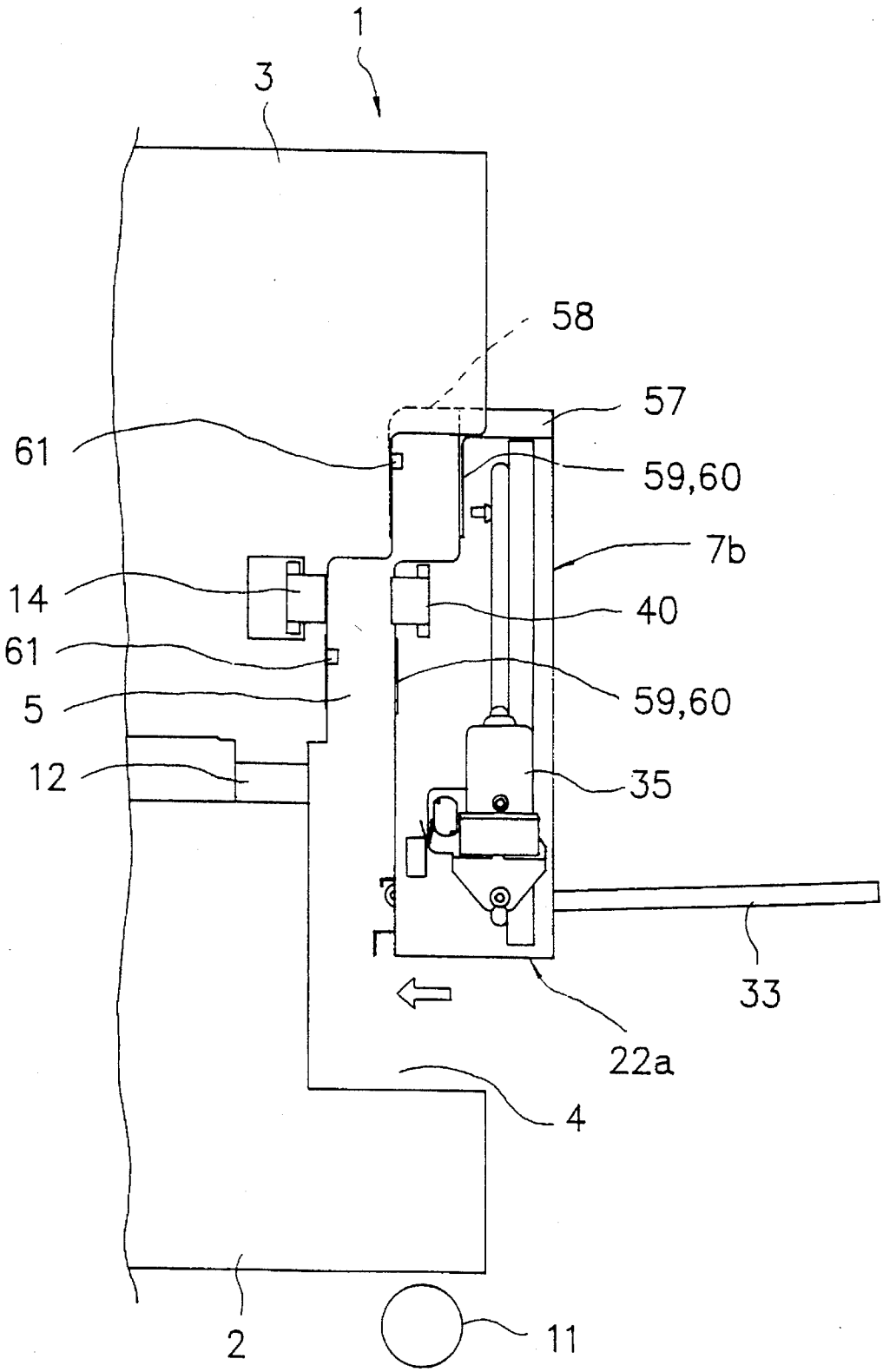
FIG. 15 is a front view showing another embodiment of constitution of the feed unit in one embodiment of the present invention.

As the releasable retaining construction of the feed unit 7 relative to the body 3, there may be adopted those shown in the exemplary embodiment in FIGS. 1 to 3, the embodiment shown in FIG. 14, and one shown in FIG. 15. On the upper part of a frame 22*a* of the feed unit 7*b* is provided a rail member 57 as a retaining means, which is releasably engaged with a rail member 58 on the side of the body 3.

The frame 22*a* of the feed unit 7*b* has a positioning plate 60 which is provided with a hole 59, and the body 3 has a positioning pin 61 which is inserted into the hole 59 of the positioning plate 60.

With the rail member 57 of the feed unit 7*b* engaged with the rail member 58 of the body 3, the feed unit 7*b* is temporarily fixed to the body 3, and then the feed unit 7*b* is moved along the rail members 57 and 58 towards the body 3. After the positioning pin 61 is properly fitted in the hole 59 of the positioning plate 60, the feed unit 7*b* is secured further on the body 3 by means of a screw.

Figure 16:
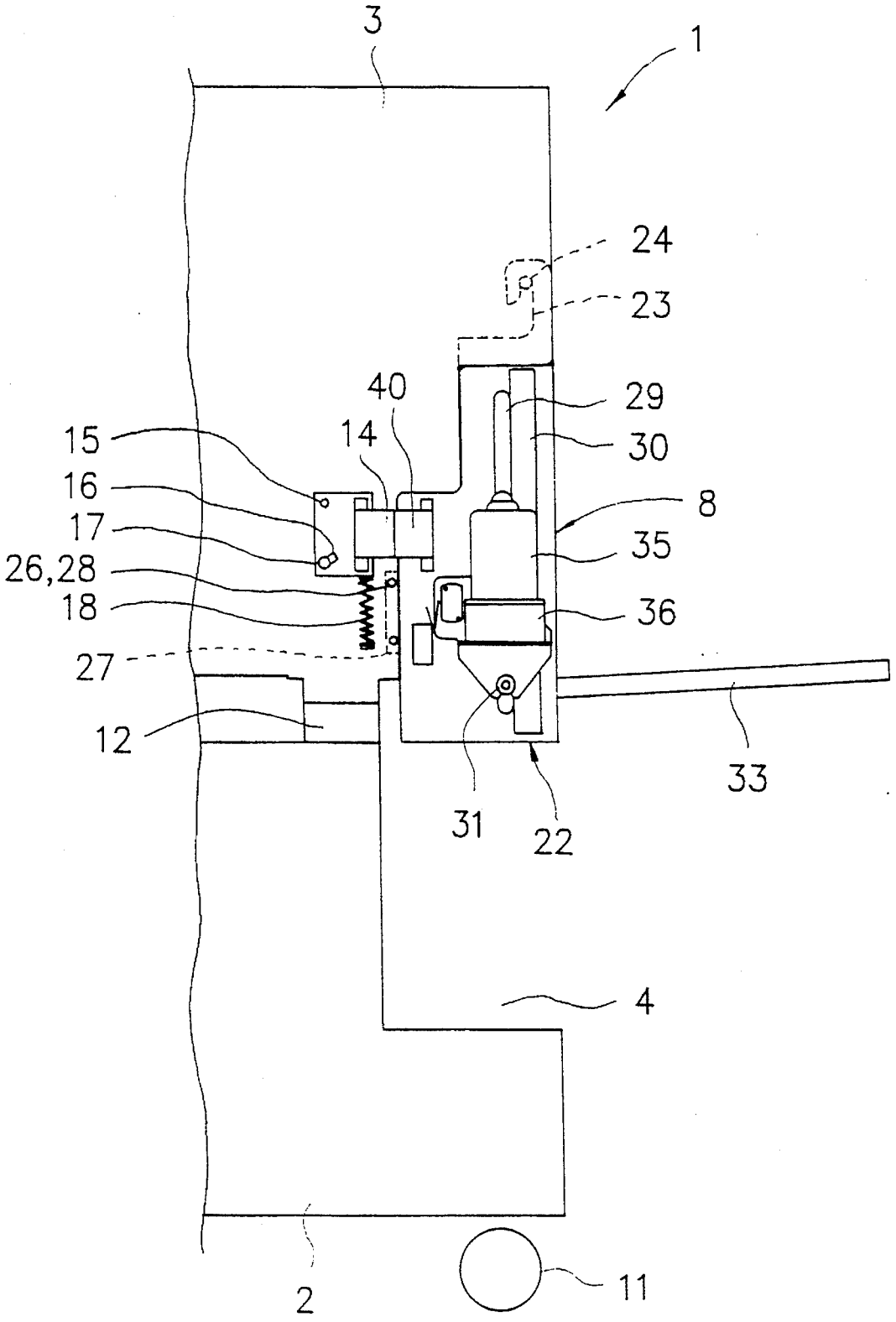
FIG. 16 is a front view with a standard feed unit mounted in one embodiment of the present invention.
Figure 17:
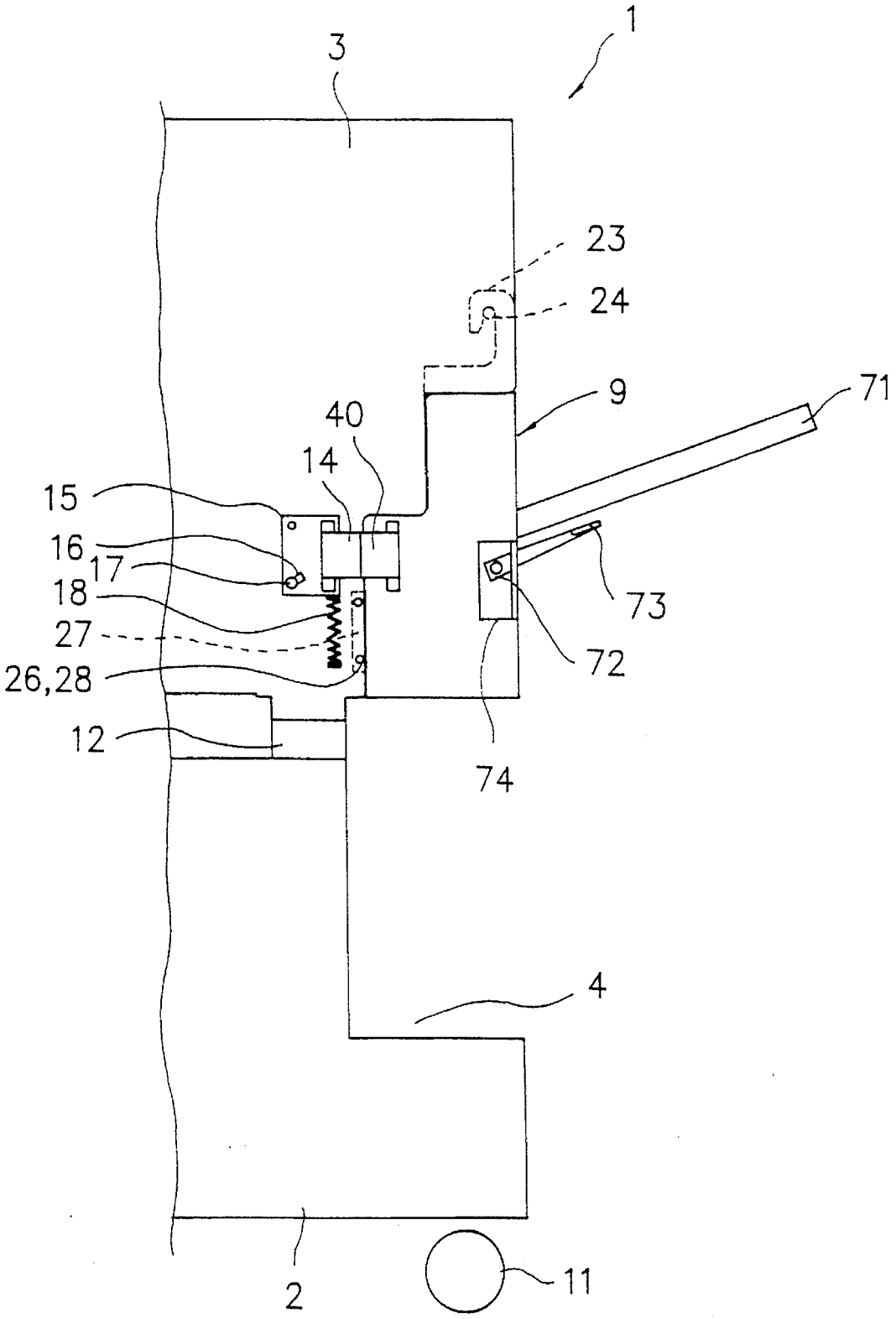
FIG. 17 is a front view of the feed unit of simple constitution in one embodiment of the present invention.

FIG. 16 shows the standard feed unit 8 to be used in the printing apparatus 1 of the present embodiment. The feed unit 8 has a capacity of holding 1000 sheets of printing paper 6, which is smaller than the feed unit 7, but is about the same in construction. The corresponding members, therefore, are designated by the same reference numerals as in FIG. 3, and will not be explained.

FIGS. 17 to 22 show the feed unit 9 of simplified construction to be used in the printing apparatus 1 of the present embodiment. The feed unit 9 is not equipped with the motor 35 unlike the feed unit 7, but is provided with a spring 70 as a driving means to raise the printing paper 6. Accordingly the feed unit 9 has a small capacity of loading printing paper of about 500 sheets.

Figure 18:
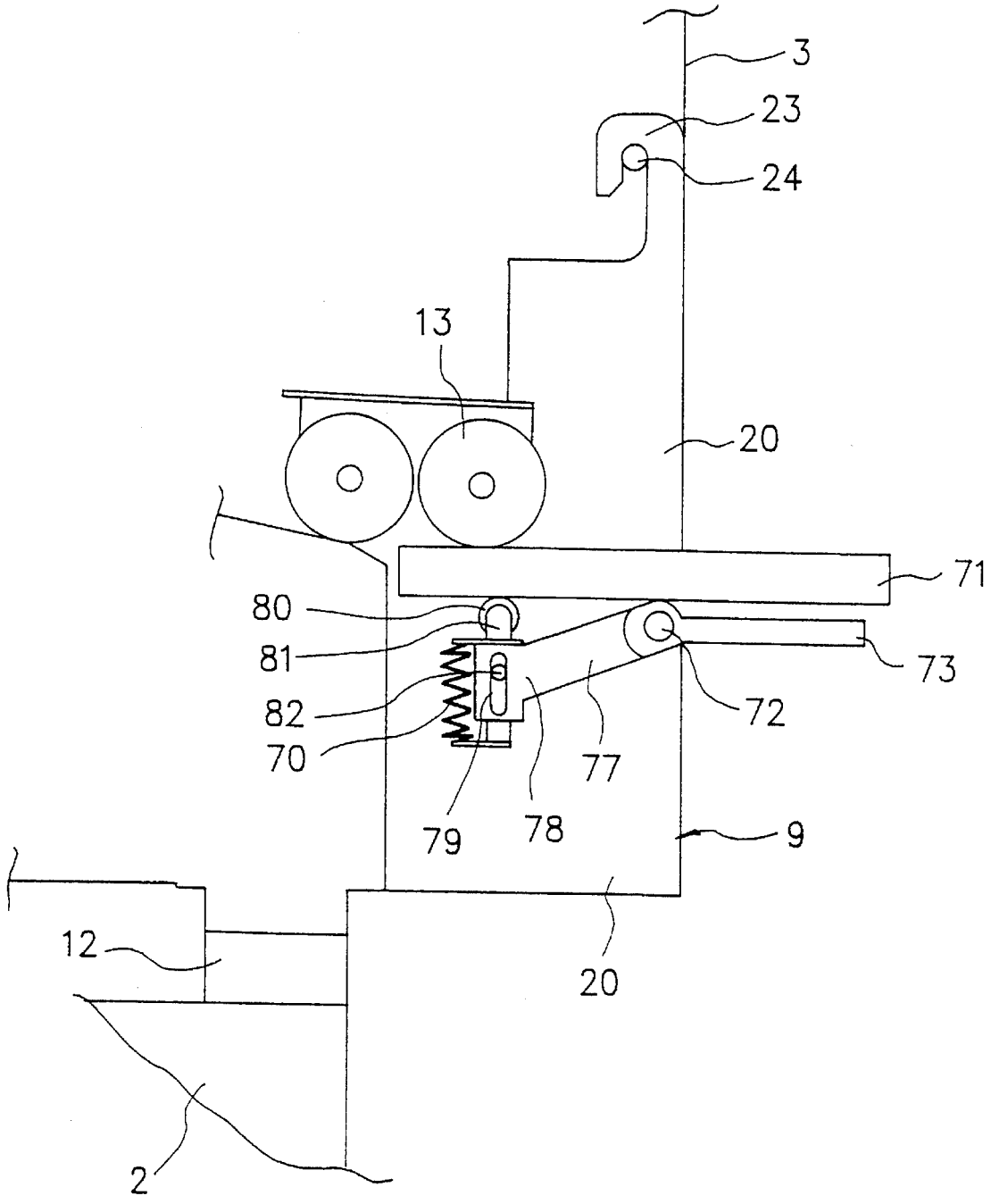
FIG. 18 is a sectional view of a major portion of the feed unit of simple constitution.
Figure 19:
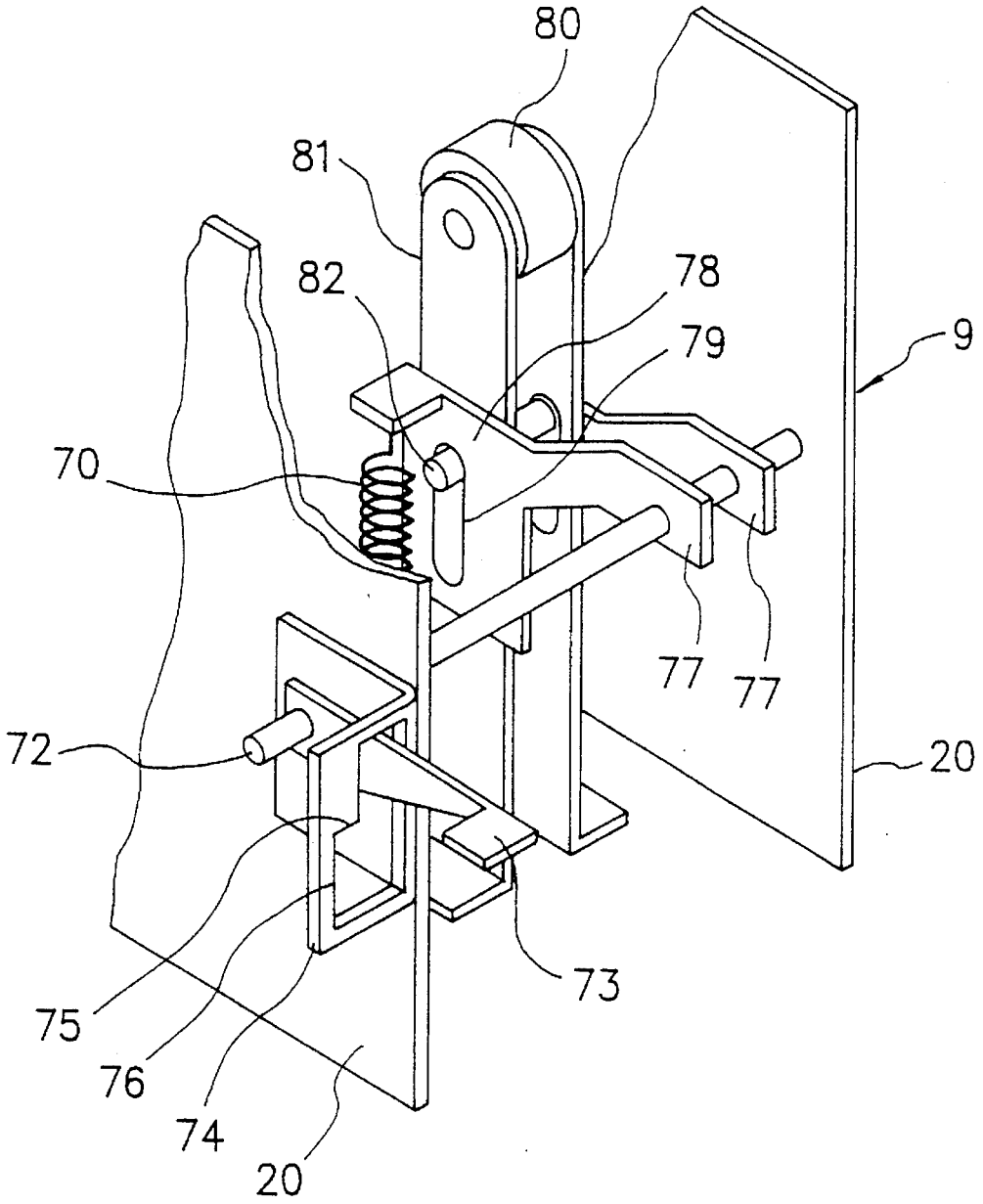
FIG. 19 is a perspective view of the major portion of the feed unit of simple constitution.

Next, a paper feed table 71 using the spring 70 which is a feature part of the feed unit 9 will be mainly explained by referring to FIGS. 18 and 19. In the drawings, the same component parts as those of the aforesaid embodiment are designated by the same reference numerals as in FIG. 3, and will not be described.

Between the side plates 20, 20 is installed a shaft 72. The shaft 72 is rotatable within a specific range, and is axially movable. One end of the shaft 72 is protruding out of one of the side plates 20; on this one end is fixed the base end of the lever 73. On the outer surface of the side plate 20 is installed a stationary plate 74 of the lever 73. In the stationary plate 74 is formed a hole 76 having a step portion 75, and the lever 73 is inserted in this hole 76.

On the shaft 72 between the side plates 20, 20 a pair of guide plates 77, 77 is connected at a specific spacing. Retaining portions 78, 78 which form free ends of the guide plates 77, 77 are provided with guide slots 79, 79 formed along approximately the vertical direction. Between the retaining portions 78, 78 is slidably held a support member 81 having a roller 80 at the upper end. Guide pins 82, 82 protrusively installed on both side surfaces of the support member 81 are engaged in the guide slots 79, 79. The lower end of the support member 81 and the holding member 78 are connected by the spring 70; the support member 81 being pressed upwardly by the spring 70.

Figure 20:
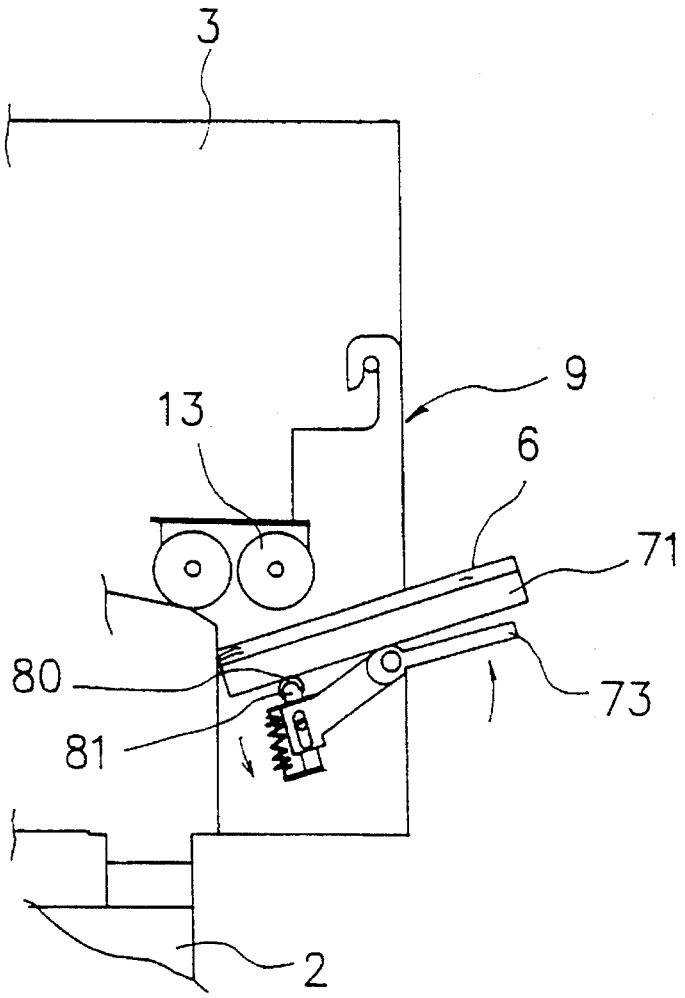
FIG. 20 is a view showing the operation of the feed unit of simple constitution.

In the above-described constitution, when the lever 73 is raised, the support member 81 lowers as shown in FIG. 20, thus widening a clearance between the pick-up roller 13 of the body 3 and the roller 80 of the feed unit 9. Here, the printing paper 6 is loaded on the roller 80 through the paper feed table 71.

Figure 21:
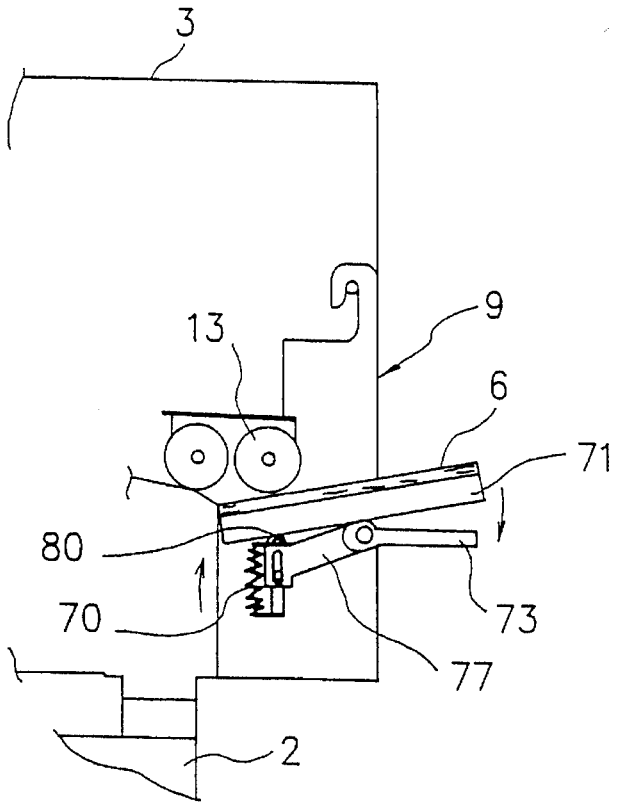
FIG. 21 is a view showing the operation of the feed unit of simple constitution.

Then, when the lever 73 is lowered as shown in FIG. 21, the paper feed table 71 is raised until the upper surface of the printing paper 6 contacts the pick-up roller 13, and the roller 80 is pushed downwardly in relation to the guide plate 77. The lever 73 is left as engaged with the step portion 75 of the hole 76 of the stationary plate 74.

Figure 22:
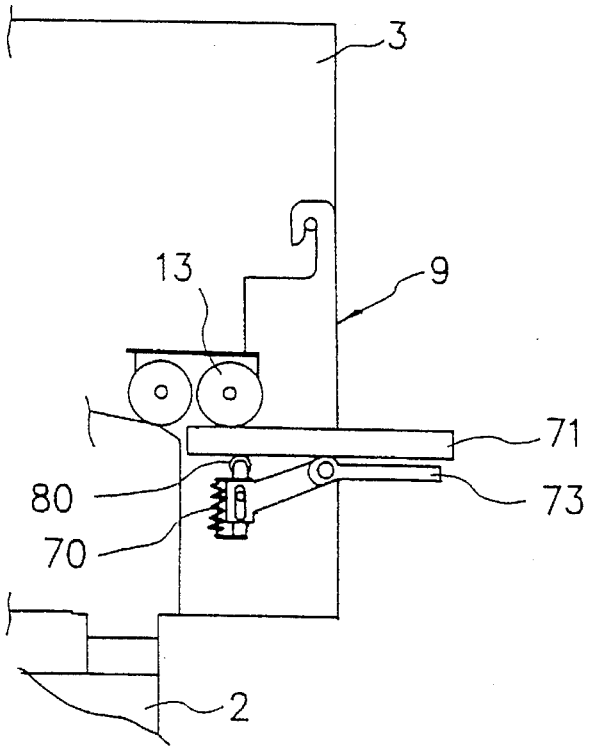
FIG. 22 is a view showing the operation of the feed unit of simple constitution.

As the printing paper 6 is successively fed in during printing operation, the roller 80 of the support member 81 is moved upwardly by the force of the spring 70, thus raising the paper feed table 71. As shown in FIG. 22, the paper feed table 71 gets almost horizontal and contacts the pick-up roller 13 when all of the sheets loaded have been fed in.

Figure 23:
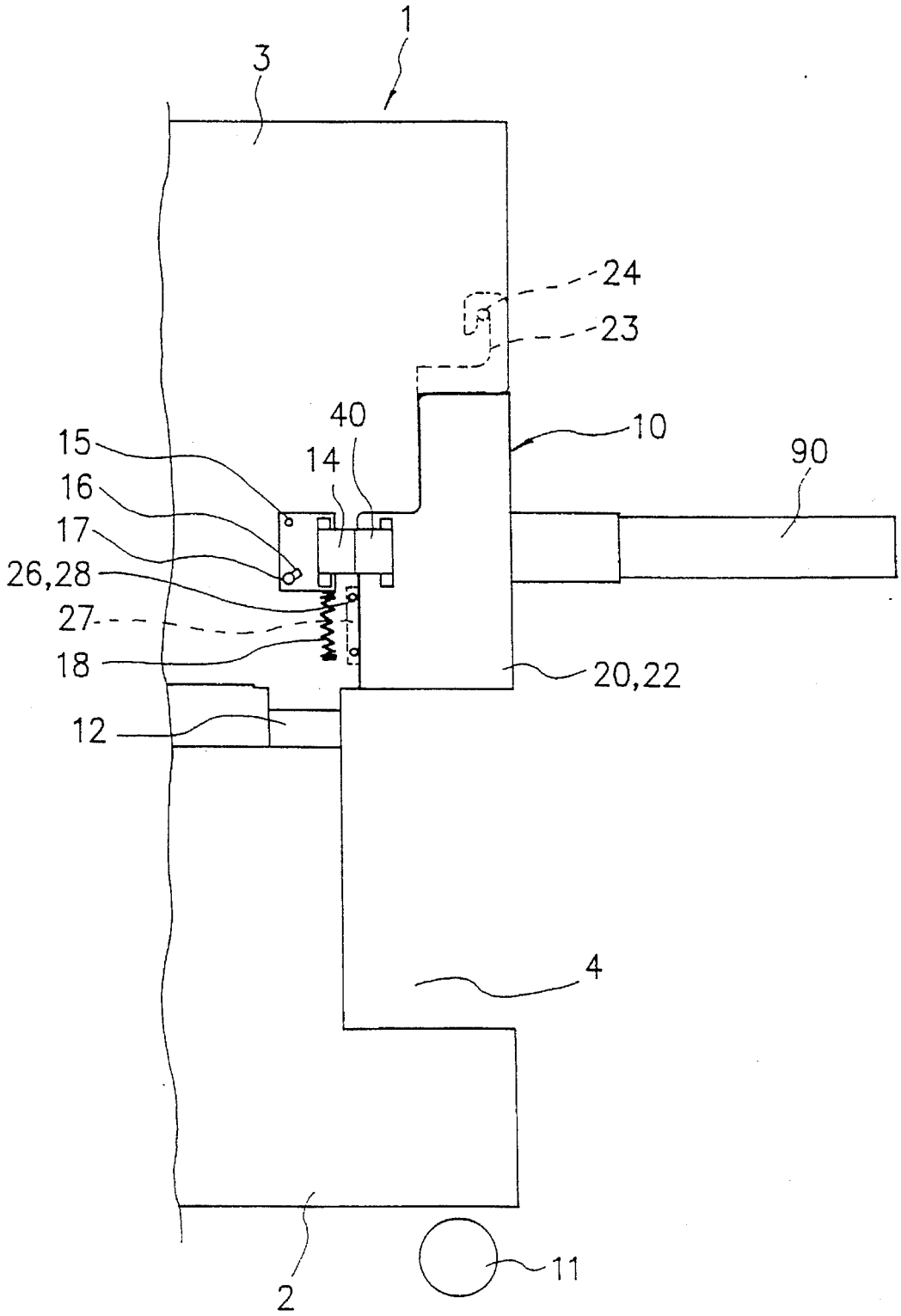
FIG. 23 is a front view of the image forming apparatus of one embodiment of the present invention with the feed unit for a paper feed cassette mounted.
Figure 24:
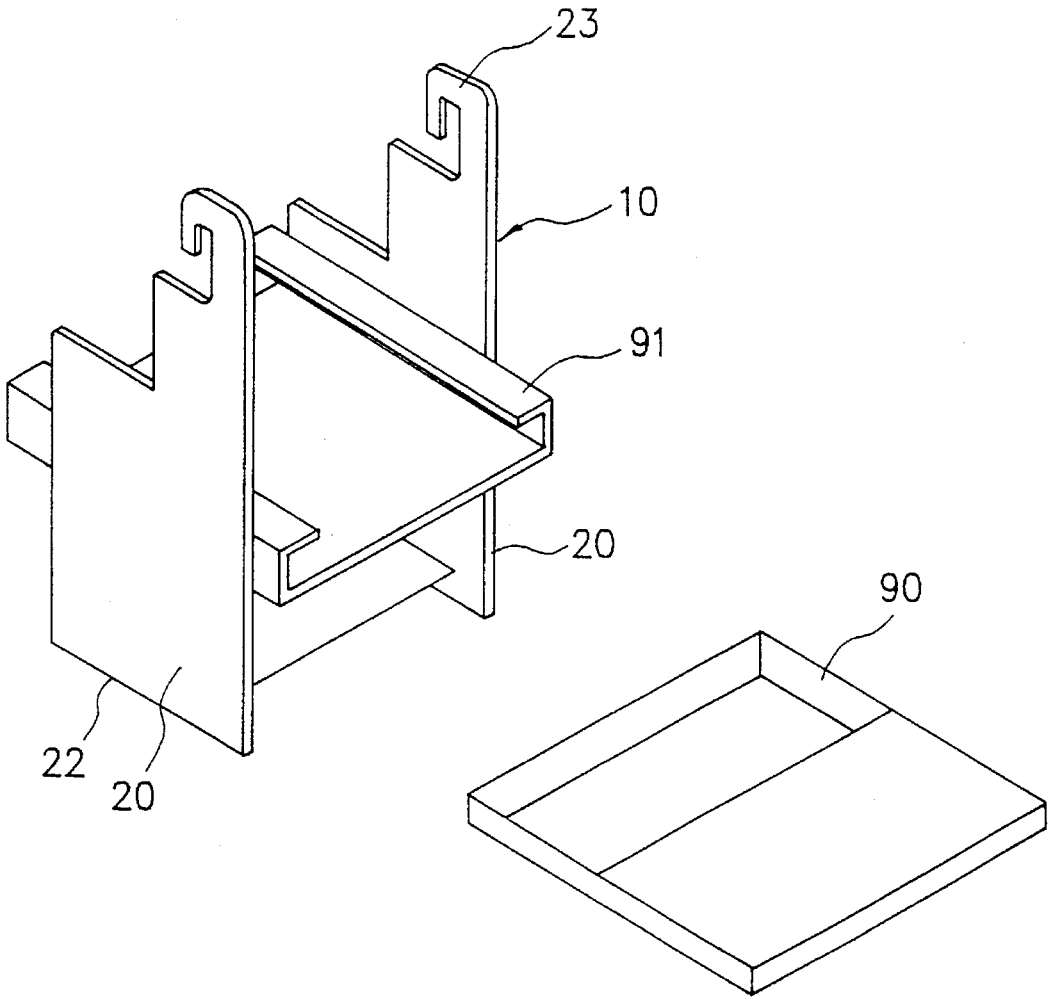
FIG. 24 is a perspective view of the feed unit for the sheet feed cassette.

FIGS. 23 and 24 show a feed unit 10 for a paper feed cassette 90 to be used in the printing apparatus 1 of the present embodiment. In FIG. 23, the same components as those of the embodiment are designated by the same reference numerals as the numerals in FIG. 3 and will not be described.

The feed unit 10 has a cassette receiver 91 secured between a pair of side plates 20, 20 of the frame 22. To this cassette receiver 91 the paper feed cassette 90 loaded with the printing paper 6 can be releasably attached.

Such a feed unit 10 for cassette, if prepared for use in this apparatus, will be convenient for printing small quantities of printing paper of specific size.

According to the image forming apparatus and the feed unit of the present invention, it is possible, as explained above, to select and install the feed unit to the body of the image forming apparatus in accordance with paper feeding conditions required. Furthermore the installation and removal of the feed unit can easily be performed.

What is claimed is:

1. An image forming apparatus for forming an image on a sheet, comprising, a body having image forming means therein and first suspending means formed at one side thereof, sheet pick-up means mounted in said body and supplying a sheet to the image forming means, and a sheet feed unit detachably mounted on said one side of said body, said sheet feed unit retaining sheets therein for supplying the sheets one by one to the body by means of the sheet pick-up means, said sheet feed unit including a frame and second suspending means fixed to the frame, said second suspending means being engageable with said first suspending means so that when the sheet feed unit is installed in the body, the second suspending means is swingably attached to the first suspending means to allow the sheet feed unit to hang from the body and then said sheet feed unit is immovably fixed to the body.

2. An image forming apparatus according to claim 1, wherein said body includes first fixing means, and said frame includes second fixing means, said first and second fixing means being arranged such that said first and second fixing means are separated when the first and second suspending means are engaged and the sheet feed unit is suspended downwardly, and the first and second fixing means are joined to immovably fix together when the sheet feed unit is turned inside the body.

3. An image forming apparatus according to claim 2, wherein said body includes a first electrical connecting section, and said feed unit includes a sheet loading table for loading said sheets, driving means for driving said sheet loading table up and down and a second electrical connecting section at a side of the driving means, said first and second electrical connecting sections being connected together when the feed unit is fixed to the body.

4. An image forming apparatus according to claim 3, wherein at least one of said first and second electrical connecting sections is rotatably attached to a member to which said at least one of the first and second electrically connecting sections is attached so that when the feed unit is rotated to connect the first and second fixing means, the first and second electrical connecting sections are electrically connected together.

5. An image forming apparatus according to claim 2, wherein said feed unit includes a sheet feed table, means for supporting the sheet feed table, and a lever for actuating the supporting means so that when the lever is actuated, the supporting means pushes the sheet feed table toward the sheet pick-up table.

6. An image forming apparatus according to claim 5, wherein said supporting means includes a spring connected to the lever, said spring urging the sheet feed table upwardly when the lever is actuated.

7. An image forming apparatus according to claim 1, wherein said body includes a housing space for housing a part of the feed unit.

8. A sheet feeding unit for use in an image forming apparatus for forming an image on a sheet, said image forming apparatus including a body, image forming means situated in the body, first suspending means formed at one side of the body, and sheet pick-up means mounted in said body and supplying the sheet to the image forming means, said sheet feeding unit comprising, a frame detachably mounted on said one side of said body, means for retaining sheets inside the frame for supplying the sheets one by one to the body by means of the sheet pick-up means, and second suspending means fixed to the frame, said second suspending means being engageable with said first suspending means so that when the sheet feed unit is installed in the body, the second suspending means is swingably attached to the first suspending means to allow the sheet feed unit to hang from the body and then the sheet feed unit is immovably fixed to the body.

9. A sheet feed unit according to claim 8, wherein said body includes first fixing means, and said frame includes second fixing means, said first and second fixing means being immovably fixed together when the sheet feed unit is installed in the body.

10. A sheet feed unit according to claim 9, wherein said body includes a first electrical connecting section, and said feed unit includes a sheet loading table for loading said sheets, driving means for driving said sheet loading table up and down and a second electrical connecting section at a side of the driving means, said first and second electrical connecting section being connected together when the feed unit is fixed to the body.

* * * * *